US012319490B2

(12) United States Patent
Kohn et al.

(10) Patent No.: US 12,319,490 B2
(45) **Date of Patent: *Jun. 3, 2025**

(54) BAG FOR TRANSPORTING MATTRESSES

(71) Applicants: Steve Kohn, Short Hills, NJ (US); Amy Rigazio, Farmingdale, NY (US)

(72) Inventors: Steve Kohn, Short Hills, NJ (US); Amy Rigazio, Farmingdale, NY (US)

(73) Assignee: Broadway Holdings IV, LLC, Monroe, NJ (US)

( * ) Notice: Subject to any disclaimer, the term of this patent is extended or adjusted under 35 U.S.C. 154(b) by 53 days.

This patent is subject to a terminal disclaimer.

(21) Appl. No.: 17/151,323

(22) Filed: Jan. 18, 2021

(65) Prior Publication Data

US 2022/0227572 A1 Jul. 21, 2022

(51) Int. Cl.
*B65D 85/64* (2006.01)
*B65D 33/08* (2006.01)

(52) U.S. Cl.
CPC ..... *B65D 85/64* (2013.01); *B65D 33/08* (2013.01); *B65D 2585/649* (2013.01)

(58) Field of Classification Search
CPC ... B65D 85/64; B65D 33/08; B65D 2585/649
USPC ..... 383/10
See application file for complete search history.

(56) References Cited

U.S. PATENT DOCUMENTS

| | | | | | |
|---|---|---|---|---|---|
| 4,252,269 | A * | 2/1981 | Peppiatt | B65D 33/10 383/120 |
| 4,730,943 | A * | 3/1988 | Johnson | B65D 75/56 383/8 |
| D377,433 | S * | 1/1997 | Funk | D6/596 |
| D898,475 | S * | 10/2020 | Sundberg | D6/606 |
| 2006/0012200 | A1* | 1/2006 | Kohn | B65D 33/065 294/157 |
| 2007/0245490 | A1* | 10/2007 | Oh | A47F 5/0018 5/413 R |
| 2012/0187012 | A1* | 7/2012 | TeVault | B65D 81/055 206/326 |
| 2021/0227993 | A1* | 7/2021 | Franco | A47C 31/105 |

FOREIGN PATENT DOCUMENTS

| | | | | |
|---|---|---|---|---|
| CN | 209058516 U | * | 7/2019 | |
| DE | 3622912 A1 | * | 1/1988 | |
| EP | 2272769 A1 | * | 1/2011 | B65D 33/01 |
| KR | 102114602 B1 | * | 5/2020 | |
| WO | WO-02065874 A1 | * | 8/2002 | A47C 31/08 |

OTHER PUBLICATIONS

KR-102114602-B1 machine translation (Year: 2024).*

* cited by examiner

*Primary Examiner* — Jes F Pascua
(74) *Attorney, Agent, or Firm* — Philip M. Weiss; WEISS & WEISS

(57) ABSTRACT

A bag used to transport and store a mattress comprising a bag sized to completely envelope the mattress. The bag has an opening in one or more ends or one or more sides for the mattress to be placed inside. A graspable area has graspable points applied to the outer surface of one or more ends, one or more side, or a top or bottom surface of the bag.

13 Claims, 8 Drawing Sheets

BAG FOR TRANSPORTING MATTRESSES

FIELD OF THE INVENTION

The present invention relates to a mattress bag having graspable areas in one or more outer panels or outer strips attached to a surface of the bag. These graspable areas increase stability when carrying the mattress.

BACKGROUND OF THE INVENTION

U.S. Pat. No. 8,739,974 relates to a mattress package having a barrier layer which encapsulates the entire mattress, two skid pads which cover and protect the top and bottom portion of the mattress, and two side trays which cover and protect the left and right sides of the mattress. The side trays cover a portion of the skid pads and the entire assembly is banded by two or more securing bands. Two or more handles are positioned on the front and back surfaces of the side trays on both the left and right sides. The handles provide grips for the mattress package to facilitate handling.

US patent publication no. 2005/0161363 relates to a mattress package with a full perimeter protection and handling piece having a barrier layer that encapsulates a mattress with a perimeter piece attached about a perimeter of the mattress proximate to the border of the mattress and extending over the adjacent surfaces of the mattress. The perimeter piece provides a grip for handling the mattress which evenly distributes stresses on the package to prevent breach or failure of the package. The perimeter piece can be positioned underneath or on top of the barrier layer.

U.S. Pat. No. 8,342,587 relates to a device for moving, carrying and storing a mattress that includes a bag sized to receive the mattress and having an opening for placing the mattress into the bag. Handles are built into an extension on at least one side or end of the bag. The extension includes multiple layers of film. The bag can comprise a sheet of plastic material with a seal for bonding two or more layers of film together a long at least a portion of the length of the side having the extension thereon.

U.S. Pat. No. 7,828,354 relates to a method for manufacturing a mattress carrier that includes forming a bag from a sheet of plastic film material. The bag is sized to receive a mattress and has an opening for placing the mattress into the bag. An extension is formed on at least one side or end of the bag. The extension comprises a plurality of layers of the plastic film material. Handles are formed as openings in the extension.

U.S. Pat. No. 7,581,772 relates to a mattress carrier that includes a bag made of a sheet of plastic film material. The bag is sized to receive a mattress and has an opening for placing the mattress into the bag. An extension on at least one side of the bag has a plurality of layers of the plastic film material formed with a gusset. Handles are formed as openings in the extension. The bag has a seal for bonding the layers of film together along at least a portion of the length of the side having the extension. The seal is formed along a line between an outer edge of the gusset and an inner edge of the gusset.

SUMMARY OF THE INVENTION

The present invention comprises a bag that transports a mattress by incorporating graspable areas into one or more outer panels or outer strips attached to the outer surface of the bag. The bag comprises one or more surfaces. It is an object of the present invention for the bag to completely envelope the mattress to protect it from water, dirt, and contaminants encountered during moving or while being stored. It is an object of the present invention to have an opening in one or more ends or sides of the bag for the mattress to be placed inside. It is an object of the present invention to further comprise a device for closing the bag once the mattress is placed in the bag. It is an object of the present invention for the closing device to seal the opening of the bag. It is an object of the present invention for the closing device to comprise double sided tape that is placed along the opening of the bag to seal the bag.

It is an object of the present invention for the graspable areas to be created by attaching an additional layer of material or outer panel along a surface of one or more ends of the bag. It is an object of the present invention for the graspable areas to be created by attaching an additional layer or outer panel along a surface of one or more sides of the bag. It is an object of the present invention for one or more additional layers to be attached to the top or bottom surface of the bag that holds the mattress. It is an object of the present invention for the one or more outer panels to be attached to the top or bottom surface of the mattress bag.

It is an object of the present invention for the one or more outer panels to be attached to the mattress bag solely by the outer panels' outer edges. It is an object of the present invention for the additional layer(s) or outer panel(s) to be attached to the bag by heat seal, glue, adhesive, stitching, staple, or any combination thereof. It is an object of the present invention for the one or more additional layers or outer panels to provide an array of points where the bag can be grasped to lift, shift, or carry the mattress. It is an object of the present invention for the graspable points to be created by one or more holes in an outer panel of the bag.

It is an object of the present invention for an outer panel to be attached to the outer surface of one or more ends of the bag. It is an object of the present invention for the outer panel to be attached to an outer surface of one or more sides of the bag. It is an object of the present invention for the one or more outer panels to be attached to the top or bottom surface of the bag.

It is an object of the present invention for the mattress bag and the one or more outer panels to be produced from the same material. It is an object of the present invention for the mattress bag and the one or more outer panels to be produced from different materials. It is an object of the present invention for the mattress bag to comprise polyethylene, polypropylene, vinyl, canvas or any other flexible material. It is an object of the present invention for the one or more outer panels to comprise polyethylene, polypropylene, vinyl, canvas, or any other flexible material.

It is an object of the present invention for the mattress bag to comprise polyethylene produced from virgin resin, post-consumer content recycled resin, post-industrial content recycled resin, bioresins, compostable resins, or any combination thereof.

It is an object of the present invention for the one or more outer panels to comprise polyethylene produced from virgin resin, post-consumer content recycled resin, post-industrial content recycled resin, bioresins, compostable resins, or any combination thereof.

It is an object of the present invention for an outer panel mounted at an end of the mattress bag to be produced separately from the mattress bag and applied to one or more ends of the bag. It is an object of the present invention for an outer panel mounted at the side of the bag to be produced separately from the mattress bag and applied to one or more sides of the bag. It is an object of the present invention for each of the one or more outer panels to be approximately 5" to 20" wide.

It is an object of the present invention for the one or more outer panels to be mounted onto the surface of the mattress bag. It is an object of the present invention for each of the one or more outer panels to comprise a single layer of material. It is an object of the present invention for each of the one or more outer panels to comprise multiple layers of material.

It is an object of the present invention for each of the one or more outer panels to comprise multiple pre-punched holes to provide graspable points. Pre-punched holes are defined as fully open holes. It is an object of the present invention for each of the one or more outer panels to be reinforced with extra mattress bag material. It is an object of the present invention for the pre-punched holes to provide graspable points that do not extend into the bag enclosure. It is an object of the present invention for the pre-punched holes to be reinforced with extra material to prevent punctures or tears.

It is an object of the present invention for each of the one or more outer panels to comprise multiple perforated holes which can be opened as needed to provide graspable points. Perforated holes are defined as covered holes that are opened by a user pushing material in the covered holes open to provide an opening, which when not pushed in the material covers the hole again. It is an object of the present invention for the perforated holes to provide graspable points that do not extend into the bag enclosure. It is an object of the present invention for the perforated holes to be reinforced with extra material to prevent punctures or tears.

It is an object of the present invention for the graspable points to allow for the mattress bag to be held at one or more of its ends. It is an object of the present invention for the graspable points to allow for the mattress bag to be held at one or more of its sides. It is an object of the present invention for the graspable points to allow for the mattress bag to be held at its top or bottom surface.

The present invention relates to a mattress bag having one or more outer strips. The bag comprises one or more surfaces. It is an object of the present invention for the bag to completely envelope the mattress to protect it from water, dirt, and contaminants encountered during moving or while being stored. It is an object of the present invention to have an opening in one or more ends or sides of the bag for the mattress to be placed inside.

It is an object of the present invention for one or more outer strips to create graspable loops when an outer strip is attached to one or more surfaces of the bag. It is an object of the present invention for graspable loops to be created by attaching an outer strip along one or more ends of the bag. It is an object of the present invention for the graspable loops to be created by attaching an outer strip along one or more sides of the bag. It is an object of the present invention for one or more outer strips to be attached on the top or bottom surface of the bag that holds the mattress. It is an object of the present invention for the outer strips to be attached to the mattress bag by a heat seal, adhesive, glue, stitching, staple or any combination thereof. It is an object of the present invention for an outer strip to provide an array of points where the bag can be grasped to lift, shift, or carry the mattress.

It is an object of the present invention for the mattress bag and the one or more outer strips to be produced from the same material. It is an object of the present invention for the mattress bag and the one or more outer strips to be produced from different materials. It is an object of the present invention for the mattress bag having one or more outer strips to comprise polyethylene, polypropylene, vinyl, canvas or any other flexible material. It is an object of the present invention for the mattress bag having one or more outer strips to comprise polyethylene produced from virgin resin, post-consumer content recycled resin, post-Industrial content recycled resin, bioresins, compostable resins, or any combination thereof.

It is an object of the present invention for the one or more outer strips to comprise polyethylene, polypropylene, vinyl, canvas, or any other flexible material. It is an object of the present invention for the one or more outer strips to comprise polyethylene that is produced from virgin resin, post-consumer content recycled resin, post-industrial content recycled resin, bioresins, compostable resins, or any combination thereof.

It is an object of the present invention for each of the one or more outer strips to be approximately 1" to 10" wide.

It is an object of the present invention for each of the one or more outer strips to consist of a single layer of material. It is an object of the present invention for each of the one or more outer strips to comprise multiple layers of material.

It is an object of the present invention for the one or more strips to be attached to the bag by mounting points. It is an object of the present invention for the mounting points to be at regular intervals along the length of the bag. It is an object of the present invention for the mounting points to create loops for grasping. It is an object of the present invention for the graspable loops to allow for the mattress bag to be held at one or more of the bags' ends. It is an object of the present invention for the graspable loops to allow for the bag to be held at or one or more of the bags' sides. It is an object of the present invention for the graspable loops to allow for the mattress bag to be held at a top or bottom surface of the mattress bag.

It is an object of the present invention for the outer strip to be produced separately from the mattress bag and affixed to one or more ends of the bag. It is an object of the present invention for the outer strip to be produced separately from the mattress bag and affixed to one or more sides of the bag. It is an object of the present invention for the outer strip to be produced separately from the mattress bag and affixed to a top or bottom surface of the bag.

The present invention further relates to graspable ends created by overlapping and joining multiple layers of the mattress bag to produce a reinforced panel at one or more of its ends. It is an object of the present invention for the reinforced panels to be created by two or more layers of mattress bag material. It is an object of the present invention for the reinforced panel to be approximately 5" to 20" wide.

It is an object of the present invention for the reinforced panels to be located on the surface of the mattress bag.

It is an object of the present invention for the reinforced panels to contain multiple pre-punched holes to provide graspable points. It is an object of the present invention for the reinforced panels to contain multiple perforated holes which can be opened as needed to provide graspable points. It is an object of the present invention for the holes providing the graspable points to not extend into the bag enclosure. It is an object of the present invention for the graspable points to allow for the mattress bag to be held at one or more of its ends.

It is an object of the present invention for the mattress bag with reinforced panels to comprise polyethylene, polypropylene, vinyl, canvas, or any other flexible material. It is an object of the present invention for the polyethylene to be produced from virgin resin, post-consumer content recycled resin, post-industrial content recycled resin, bioresins, compostable resins, or any combination thereof.

The present invention relates to a mattress bag that has extended corners. It is an object of the present invention for the mattress bag with extended corners to comprise polyethylene, polypropylene, vinyl, canvas, or any flexible material. It is an object for the polyethylene to be produced from virgin resin, post-consumer content, recycled resin, post-industrial content recycled resin, bioresins, or any combination thereof.

It is an object of the present invention for the extended corners to be created by folding and joining multiple layers of the mattress bag to produce an extended corner at each end of the bag. It is an object of the present invention for the extended corners produced to be approximately 5" to 12" long. It is an object of the present invention for the extended corners to be created by two or more layers of the mattress bag material.

It is an object of the present invention for the extended corners to contain multiple pre-punched holes to provide graspable points.

It is an object of the present invention for the extended corners to contain multiple perforated holes which can be opened as needed to provide graspable points. It is an object of the present invention for the holes providing graspable points to not extend into the bag enclosure. It is an object of the present invention for the extended corners to allow for the mattress bag to be held at its ends.

The present invention relates to a method for manufacturing a mattress carrier comprising: forming a bag sized to receive a mattress through an opening in the mattress bag; forming a one or more panels or one or more strips; attaching the one or more panels or one or more strips to the mattress bag. Each of the one or more strips or panels has graspable points which can be grasped by a user.

It is an object of the present invention wherein the method comprises that the one or more panels is only attached to the mattress bag at the panels' edges. It is an object of the present invention wherein the method comprises that the one or more panels is only attached to the mattress bag at two of the panels' edges. It is an object of the present invention for a panel to be attached to one or more ends of the mattress bag. It is an object of the present invention for a strip to be attached to one or more ends of the bag. It is an object of the present invention for a panel to be attached to one or more sides of the mattress bag. It is an object of the present invention for a strip to be attached to one or more sides of the mattress bag. It is an object of the present invention for one or more panels to be attached to a bottom or top surface of the mattress bag. It is an object of the present invention for one or more strips to be attached to a bottom or top surface of the mattress bag. It is an object of the present invention for the each of the one or more panels to have graspable points that comprise one or more pre-punched holes in one or more panels. It is an object of the present invention for each of the one or more panels to have graspable points that comprise one or more perforated holes. It is an object of the present invention for the one or more strips to create graspable points by having mounting points created as the outer strip is attached to the mattress bag.

DETAILED DESCRIPTION OF THE INVENTION

Figure 1B:
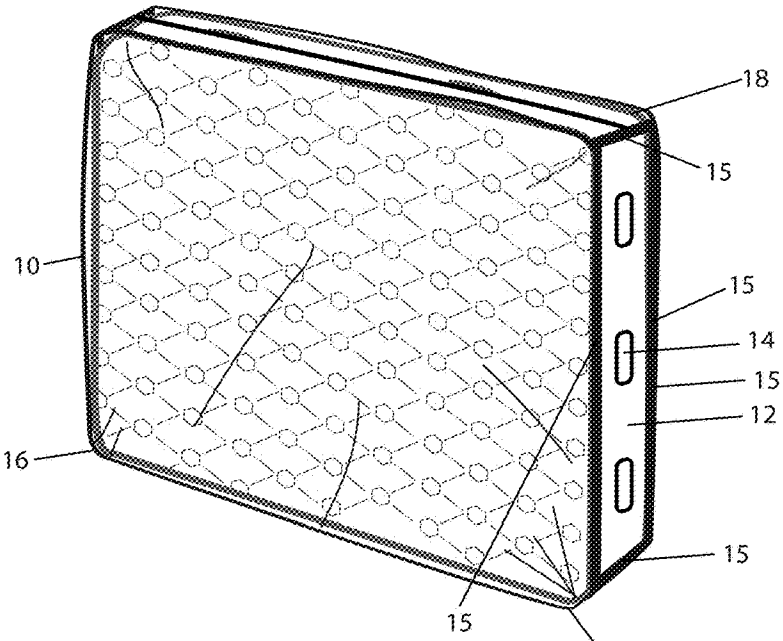
FIG. 1*b* is a front closed view of the mattress bag of the present invention having a mattress inside the mattress bag and an outer panel mounted to one end of the mattress bag.
Figure 1A:
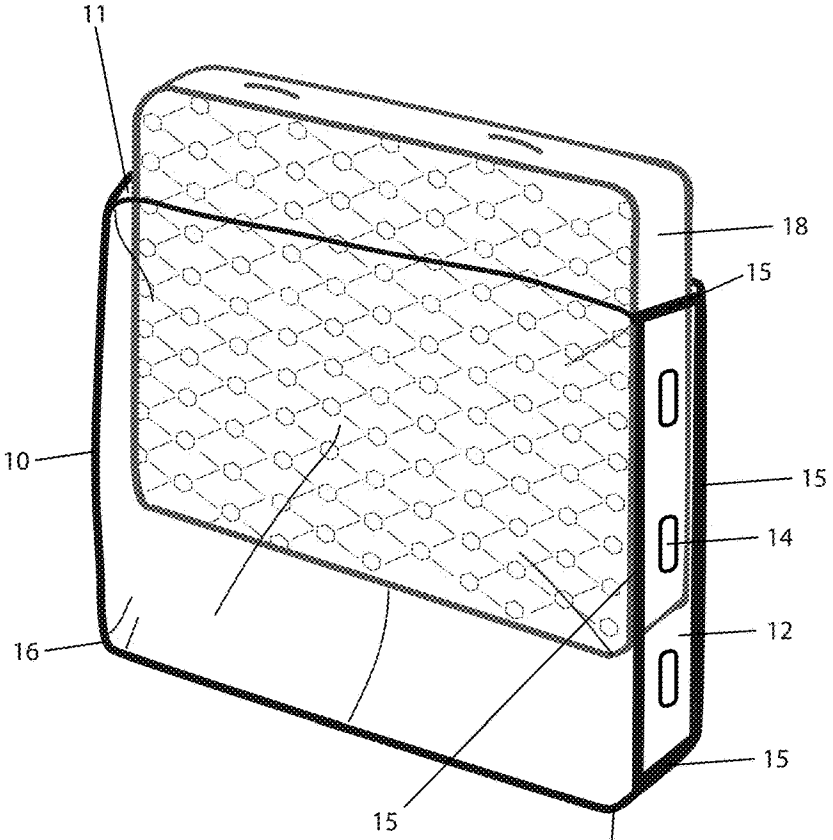
FIG. 1*a* is a front open view of the mattress bag of the present invention having a mattress and an outer panel mounted to one end of the mattress bag.

FIG. 1*a* shows a mattress bag 10 having a side opening 11 for a mattress 18. The mattress bag 10 has as outer panel 12 attached by the edges 15 of the outer panel 12 to the end 13 of the mattress bag 10. The outer panel 12, shown as an end mounting, has holes 14, shown as pre-punched holes for placement of a hand. A similar outer panel (not shown) is located at end 16.

FIG. 1*b* shows the mattress bag 10 in the closed position having a mattress 18 within the bag 10. The mattress bag 10 has an outer panel 12 attached by the edges 15 of the outer panel 12 to the end 13 of the mattress bag 10. The outer panel 12, shown as an end mounting, has holes 14, shown as pre-punched holes for placement of a hand. A similar outer panel (not shown) is located at end 16.

Figure 2B:
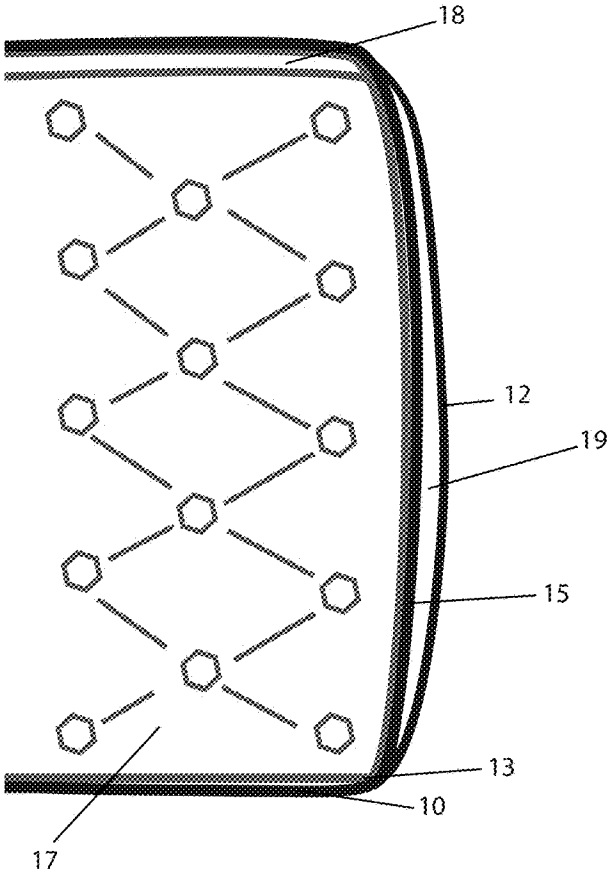
FIG. 2*b* shows a partial front view of the mattress bag of FIG. 1*b* of the present invention having a mattress inside the mattress bag and an outer panel mounted to one end of the mattress bag.
Figure 2A:
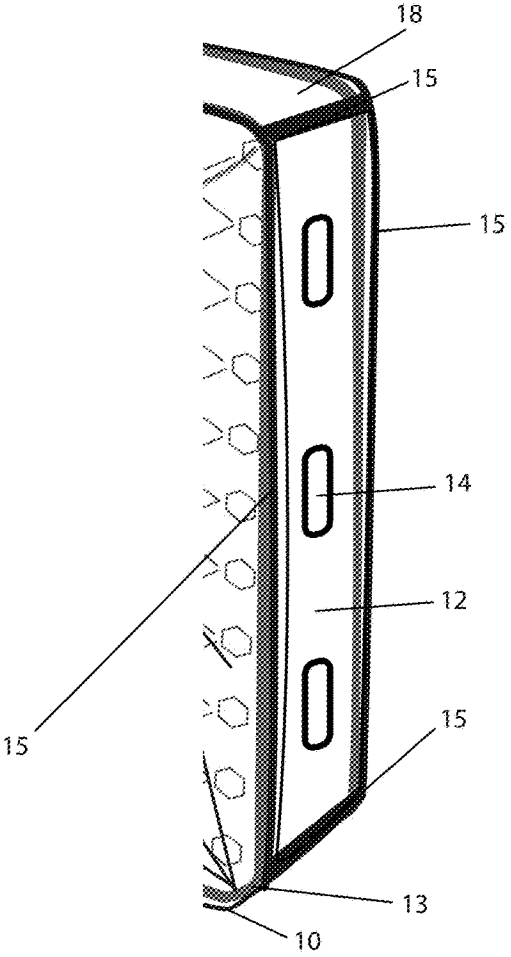
FIG. 2*a* shows an end view of the mattress bag of FIG. 1*b* of the present invention having a mattress inside the mattress bag and an outer panel mounted to one end of the mattress bag.

FIG. 2*a* shows an end view of the mattress bag 10 of FIG. 1*b* showing the end 13 of the mattress bag 10 having the mattress 18 inside the closed mattress bag 10. The outer panel 12 is attached by the edges 15 of the outer panel 12 to the end 13 of the mattress bag 10. The outer panel 12 has pre-punched holes 14. The outer panel 12 is pulled away from end 13 allowing a user's hand to be placed in the hole 14.

FIG. 2*b* shows a partial front view of the mattress bag 10 of FIG. 1*b* showing the front side 17 and the end 13 of the mattress bag 10 having the mattress 18 inside the closed mattress bag 10. The edges 15 of the outer panel 12 are attached to the mattress bag 10 and the central section of the outer panel 12 is separated from the mattress bag 10 creating a space 19 allowing a user to fit their hand through holes 14 (not shown) located on the outer panel 12.

Figure 3B:
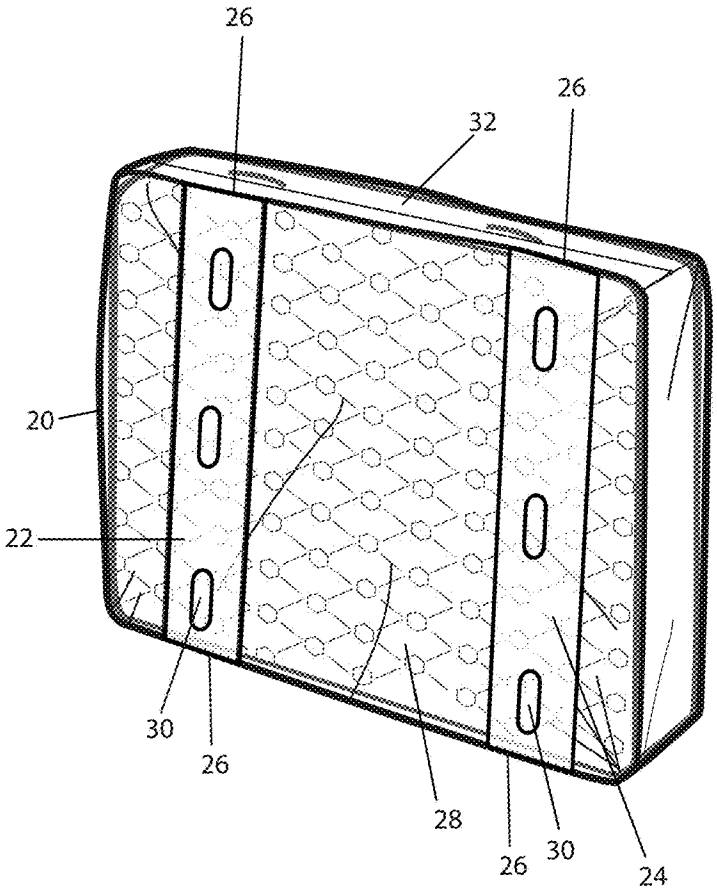
FIG. 3*b* is a front closed view of the mattress bag of the present invention having a mattress inside the mattress bag and outer panels with top surface mounting to the mattress bag.
Figure 3A:
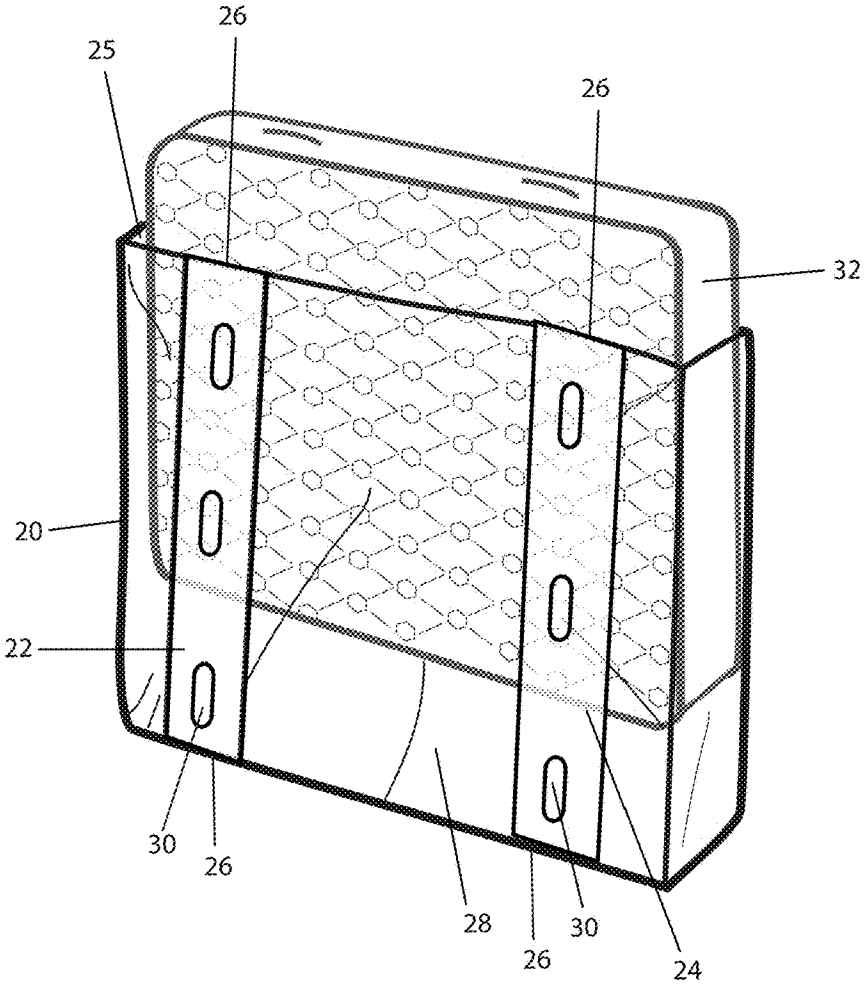
FIG. 3*a* is a front open view of the mattress bag of the present invention having a mattress and a mattress bag having outer panels with top surface mounting to the mattress bag.

FIG. 3*a* shows the mattress bag 20 having the mattress 32 inside the side opening 25 of the mattress bag 20. Outer panels 22 and 24 are attached by its edges 26 to the top front surface 28 of the mattress bag 20. Each of the outer panels 22 and 24 has holes 30 shown as pre-punched holes.

FIG. 3*b* shows the mattress bag 20 having the mattress 32 inside the closed mattress bag 20. Outer panels 22 and 24 are attached by its edges 26 to the top front surface 28 of the mattress bag 20. Each of the outer panels 22 and 24 has holes 30 shown as pre-punched holes.

Figure 4:
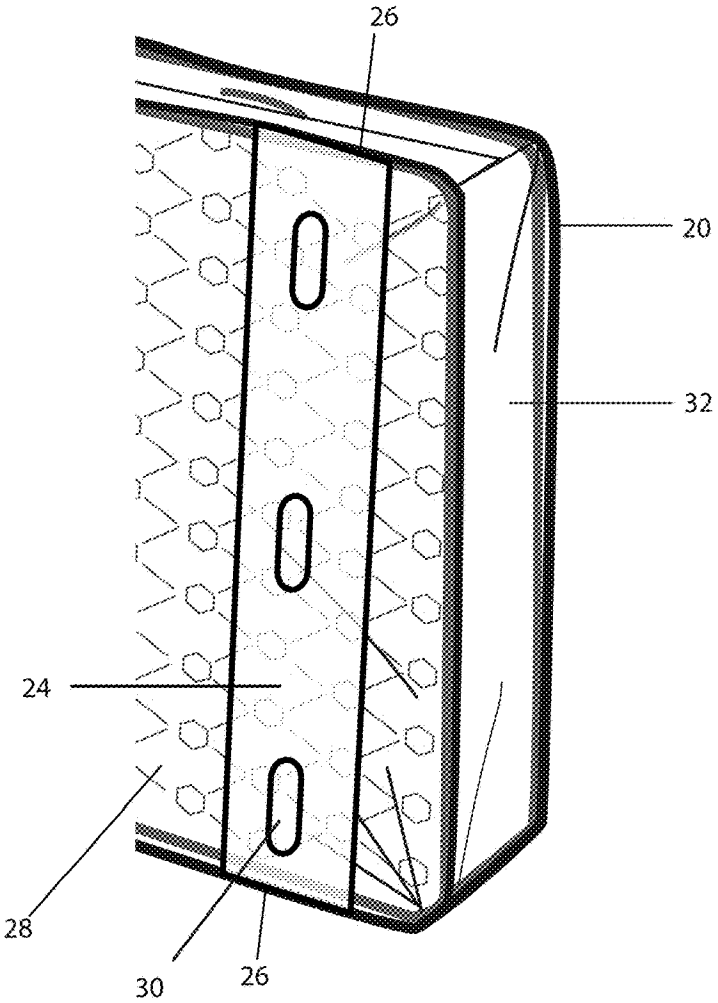
FIG. 4 is a partial front closed view of the mattress bag of FIG. 3*b*.

FIG. 4 shows a partial front end view of FIG. 3*b* showing the mattress bag 20 having the mattress 32 inside the closed mattress bag 20. Outer panel 24 is attached by its edges 26 to the top front surface 28 of the mattress bag 20. Outer panel 24 has holes 30 shown as pre-punched holes.

Figure 5:
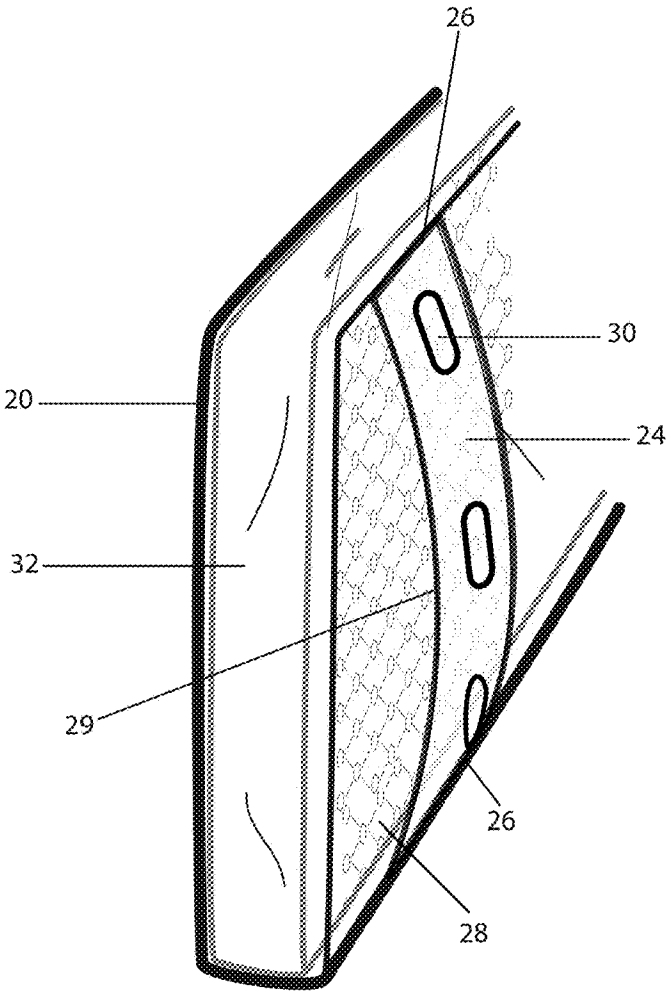
FIG. 5 is an end view of the mattress bag of FIG. 4.

FIG. 5 shows an end view of FIG. 4 showing the mattress bag 20 having the mattress 32 inside the closed mattress bag 20. Outer panel 24 is attached by its edges 26 to the top front surface 28 of the mattress bag 20 and the inner part 29 of the outer panel 24 is spaced from the mattress bag 20 allowing a user to fit their hand through holes 30 and within the outer panel 24. Outer panel 24 has holes 30 shown as pre-punched holes.

Figure 6B:
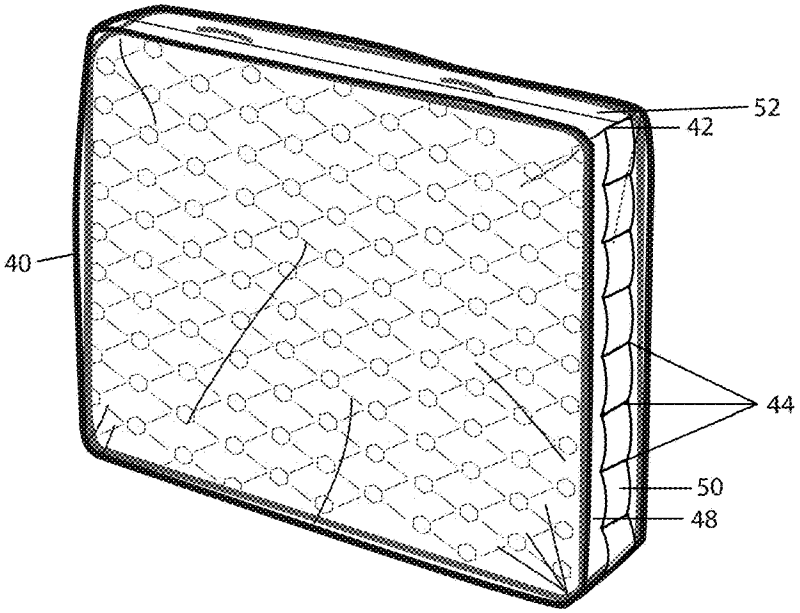
FIG. 6*b* is a front closed view of the mattress bag of the present invention having a mattress inside the mattress bag and an outer strip with end mounting to the mattress bag.
Figure 6A:
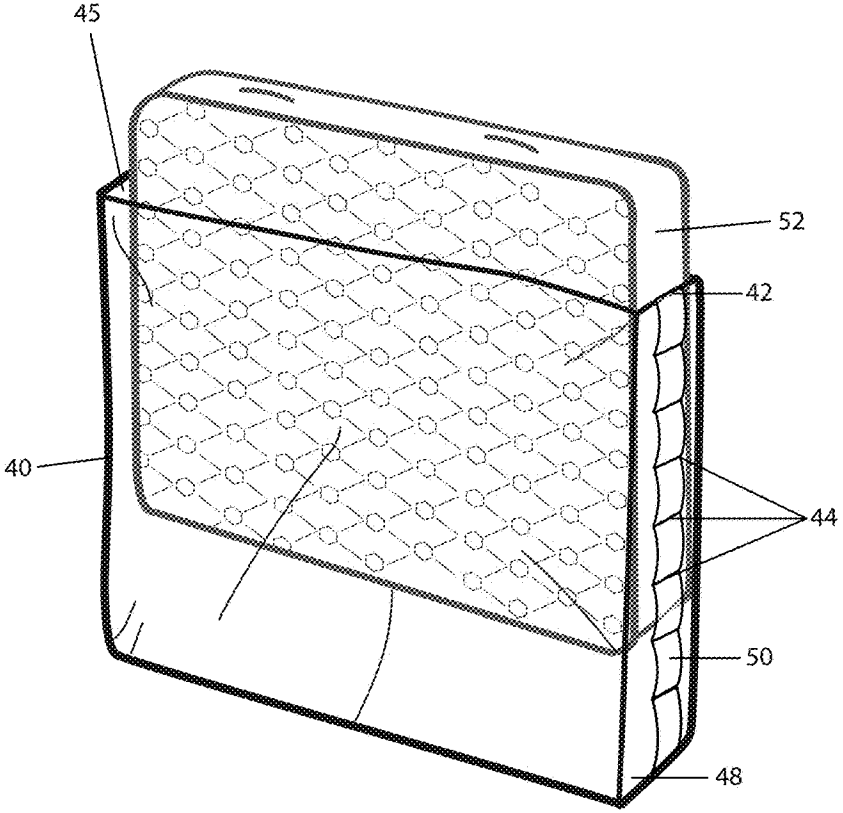
FIG. 6*a* is a front open view of the mattress bag of the present invention having a mattress inside the mattress bag and an outer strip with end mounting to the mattress bag.

FIG. 6*a* shows a front view of the mattress bag 40 having the mattress 52 inside side opening 45 of the mattress bag 40. The mattress bag 40 has an outer strip 42 attached by several mounting points 44 to the end 48 of the mattress bag 40. The outer strip 42 and the several mounting points 44 form multiple graspable loops 50.

FIG. 6*b* shows the mattress bag 40 in the closed position having a mattress 52 within the bag 40. The mattress bag 40 has an outer strip 42 attached by the several mounting points 44 to the end 48 of the mattress bag 40. The outer strip 42 and the several mounting points 44 form graspable loops 50.

Figure 7:
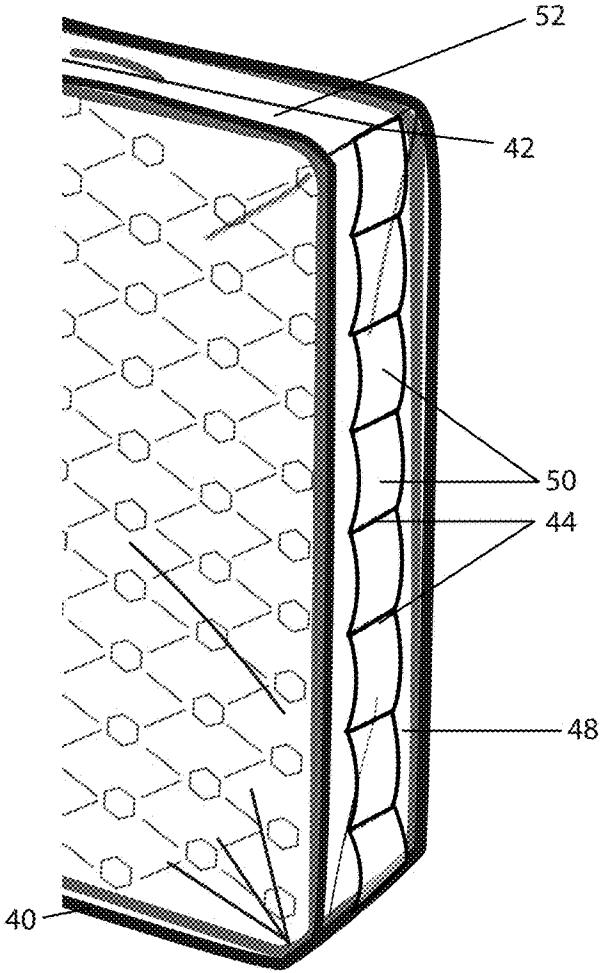
FIG. 7 is a front end view of FIG. 6*b* showing an outer strip mounted to one end of the mattress bag.

FIG. 7 shows a partial front end view of FIG. 6*b* showing the mattress bag 40 having the mattress 52 inside the closed mattress bag 40. Outer strip 42 is attached to the end 48 of the mattress bag 40 by mounting points 44. Outer strip 42 and mounting points 44 form graspable loops 50.

Figure 8:
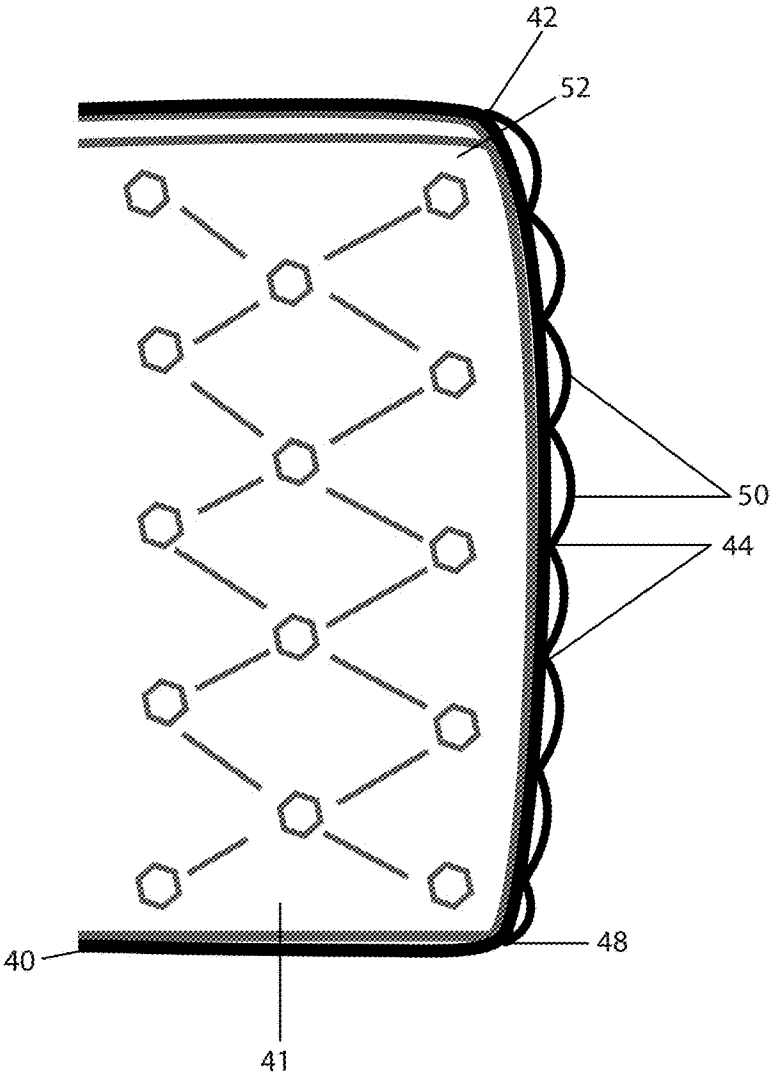
FIG. 8 is a partial front view of FIG. 6*b* showing an outer strip mounted to one end of the mattress bag.

FIG. 8 shows a partial front view of FIG. 6*b* showing the front side 41 and the end 48 of the mattress bag 40 having the mattress 52 inside the closed mattress bag 40. Outer strip 42 is attached to the end 48 of the mattress bag 40 by mounting points 44 to form graspable loops 50.

Figure 9B:
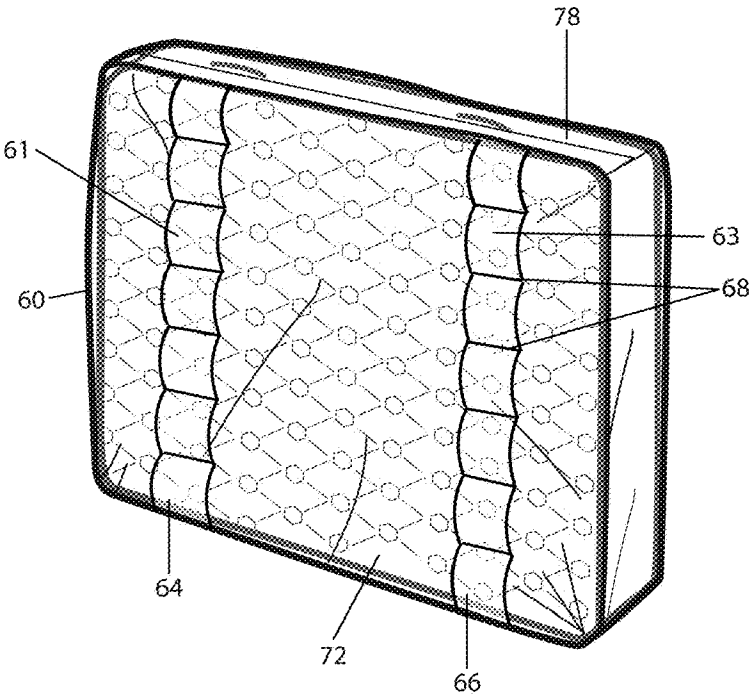
FIG. 9*b* is a front closed view of the mattress bag of the present invention having a mattress inside the mattress bag and outer strips with top surface mounting to the mattress bag.
Figure 9A:
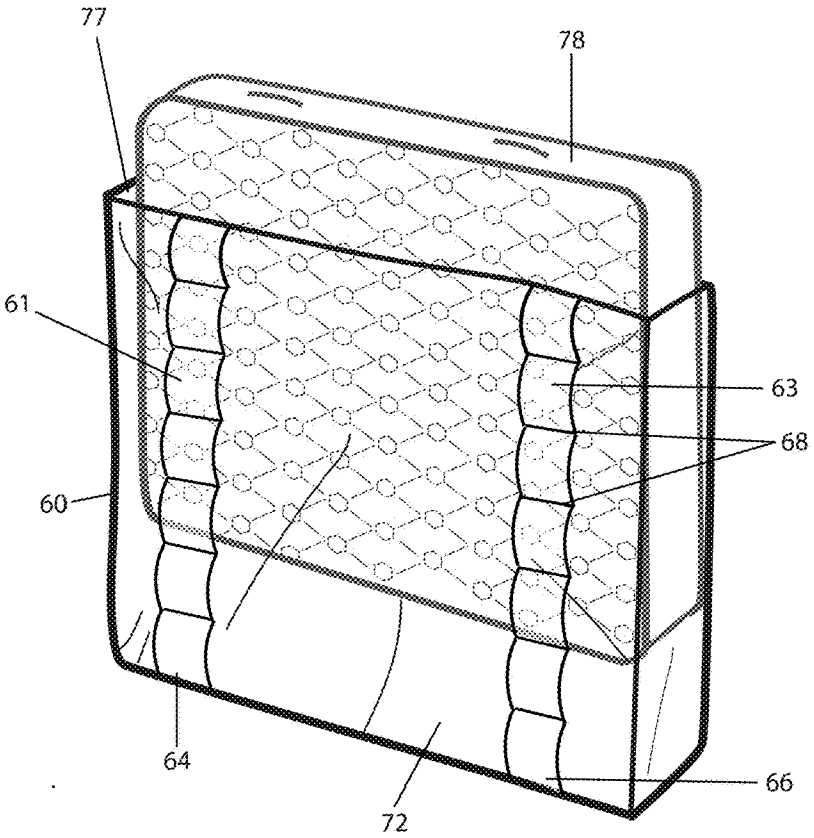
FIG. 9*a* is a front open view of the mattress bag of the present invention having a mattress and outer strips with top surface mounting to the mattress bag.

FIG. 9*a* shows the mattress bag 60 having the mattress 78 inside side opening 77 of the mattress bag 60. Outer strips 64 and 66 are attached by mounting points 68 to the top front surface 72 of the mattress bag 60. Each of the outer strips 64 and 66 form graspable loops 61 and 63 respectively.

FIG. 9*b* shows the mattress bag 60 having the mattress 78 inside the closed mattress bag 60. Outer strips 64 and 66 are attached by mounting points 68 to the top front surface 72 of the mattress bag 60. Each of the outer strips 64 and 66 forms graspable loops 61 and 63 respectively.

Figure 10:
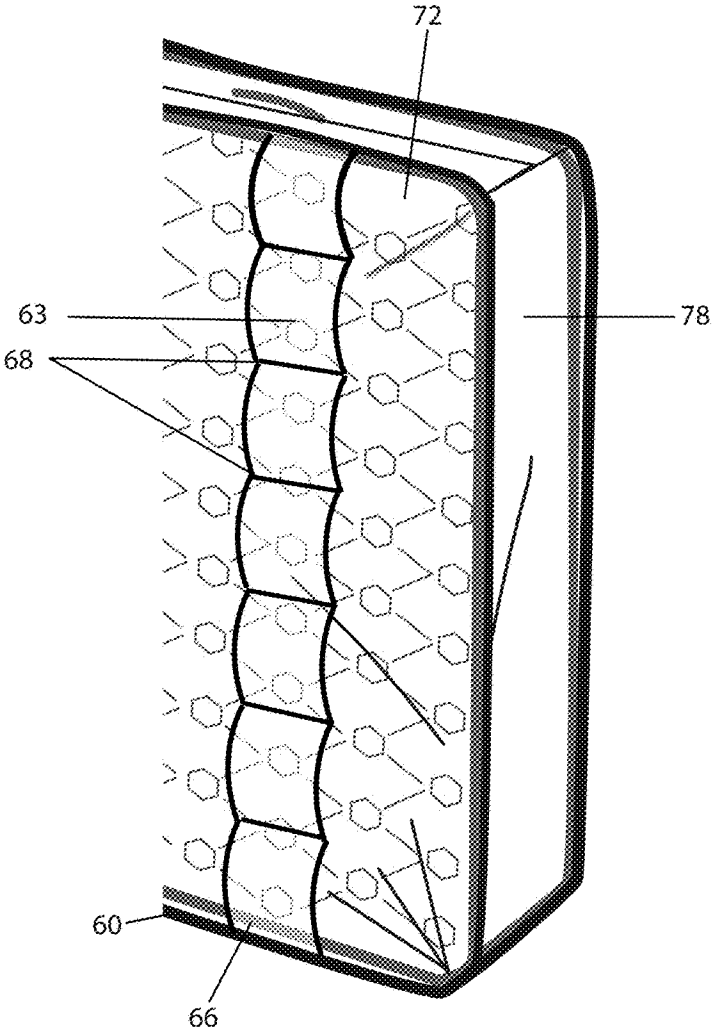
FIG. 10 is a partial front closed view of FIG. 9*b*.

FIG. 10 shows a partial front end view of FIG. 9*b* showing the mattress bag 60 having the mattress 78 inside the closed mattress bag 60. Outer strip 66 is attached by mounting points 68 to the top front surface 72 of the mattress bag 60. Outer strip 66 forms graspable loops 63.

Figure 11:
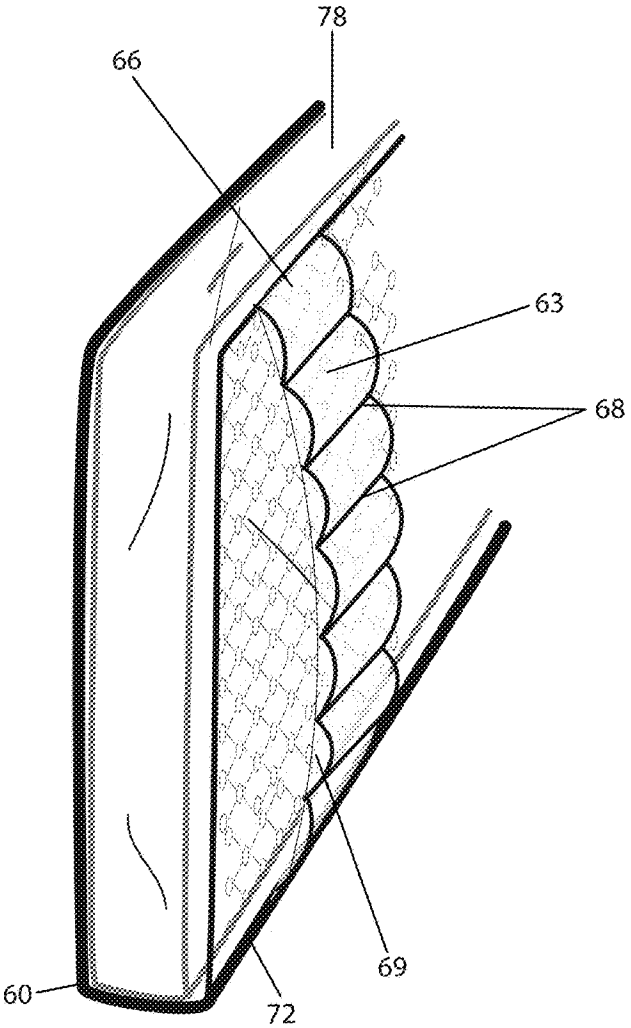
FIG. 11 is an end view of FIG. 10.

FIG. 11 shows an end view of FIG. 10 showing the mattress bag 60 having the mattress 78 inside the closed mattress bag 60. Outer strip 66 is attached by mounting points 68 to the top front surface 72 of the mattress bag 60. Outer strip 66 forms a graspable loop 63. Space 69 formed by the graspable loop 63 allows the user to place their hand inside the graspable loop 63.

The invention claimed is:

1. A bag to transport and store a mattress comprising:
a bag sized to completely envelope said mattress;
said bag comprising one or more surfaces;
said bag having two ends and two sides;
said bag having an opening in one or more ends or one or more sides for said mattress to be placed inside;
said bag having outer panels having graspable points created by at least two holes in said outer panels of said bag;
each of said outer panels having a central section;
each of said outer panels having four sides;
each of said four sides having an edge;
each of said outer panels created by attaching an additional layer of material along ends, sides, or a top or bottom surface or a top and bottom surface of said bag;
each of said outer panels attached solely by two edges to said bag so that said central section of each of said outer panels is separate from said bag creating a space for a user to fit their hand through said holes in each of said outer panels;
each of said outer panels constructed so that it can be pulled away from said bag while remaining attached to said bag at said two edges creating said space;
each of said outer panels providing an array of points where said bag can be grasped to lift, shift, or carry said mattress;
each of said outer panels sealed to said bag by said two edges that are parallel creating a planar surface with said graspable points.

2. The bag of claim 1 wherein each of said outer panels is attached to outer surface of each of said ends of said bag.

3. The bag of claim 1 wherein each of said outer panels is attached to outer surface of each of said sides of said bag.

4. The bag of claim 1 wherein each of said outer panels is attached to top or bottom surface or top and bottom surface of said bag.

5. The bag of claim 1 wherein said bag and said outer panels are comprised of polyethylene, polypropylene, vinyl, canvas, or any other flexible material.

6. The bag of claim 5 wherein said polyethylene is produced from virgin resin, post-consumer content recycled resin, post-industrial content recycled resin, bioresins, compostable resins, or any combination thereof.

7. The bag of claim 1 wherein each of said outer panels are approximately 5" to 20" wide.

8. The bag of claim 1 wherein each of said outer panels is a single layer of material.

9. The bag of claim 1 wherein each of said outer panels comprises multiple layers of material.

10. The bag of claim 1 wherein each of said outer panels comprises multiple pre-punched holes to provide said graspable points.

11. The bag of claim 10 wherein said pre-punched holes do not extend into enclosure of said bag.

12. The bag of claim 1 further comprising a device for closing said bag once said mattress is placed in said bag.

13. The bag of claim 12 wherein said device seals said bag closed.

* * * * *